US008278538B1

(12) United States Patent
D'Anda et al.

(10) Patent No.: US 8,278,538 B1
(45) Date of Patent: Oct. 2, 2012

(54) RESONATING GUITAR WITH RESONATOR CONDUCTOR

(75) Inventors: Joseph S. D'Anda, Montclair, CA (US); Kerry Kilbride, La Canada-Flintridge, CA (US); Edric Adams, Santa Ana, CA (US); Jeffrey L. Abercrombie, La Canada-Flintridge, CA (US)

(73) Assignee: Kerrick Enterprises, Inc., Santa Ana, CA (US)

( * ) Notice: Subject to any disclaimer, the term of this patent is extended or adjusted under 35 U.S.C. 154(b) by 0 days.

(21) Appl. No.: 13/048,502

(22) Filed: Mar. 15, 2011

(51) Int. Cl.
*G10D 3/02* (2006.01)

(52) U.S. Cl. ..... 84/294; 84/296; 84/267; 84/291

(58) Field of Classification Search ..... None
See application file for complete search history.

(56) References Cited

U.S. PATENT DOCUMENTS

| | | | | | |
|---|---|---|---|---|---|
| 906,612 | A | * | 12/1908 | Cayton | 84/291 |
| 1,607,449 | A | * | 11/1926 | Edwards | 84/263 |
| 1,729,244 | A | * | 9/1929 | Carlson | 84/277 |
| 1,741,453 | A | * | 12/1929 | Dopyera | 84/296 |
| 1,750,843 | A | * | 3/1930 | Kirk | 84/291 |
| 1,762,617 | A | * | 6/1930 | Dopyera | 84/296 |
| 1,808,756 | A | * | 6/1931 | Beauchamp | 84/296 |
| 1,808,757 | A | * | 6/1931 | Beauchamp | 84/296 |
| 1,872,633 | A | * | 8/1932 | Dopyera | 84/296 |
| 1,887,861 | A | * | 11/1932 | Schireson | 84/294 |
| 1,896,484 | A | * | 2/1933 | Dopyera | 84/296 |
| 1,927,575 | A | * | 9/1933 | Sehireson | 84/296 |
| 2,027,723 | A | * | 1/1936 | Dopyera | 84/296 |
| 2,029,469 | A | * | 2/1936 | Dopyera | 84/296 |
| 2,042,080 | A | * | 5/1936 | Turner | 84/296 |
| 2,045,265 | A | * | 6/1936 | Dopyera | 84/292 |
| 2,046,331 | A | * | 7/1936 | Loar | 84/307 |
| 2,089,629 | A | * | 8/1937 | Stowe | 84/294 |
| 2,139,099 | A | * | 12/1938 | Robertson | 84/296 |
| 2,158,322 | A | * | 5/1939 | Dopyera | 84/296 |
| 2,260,066 | A | * | 10/1941 | Vitalis | 84/294 |
| 3,314,324 | A | * | 4/1967 | Williams | 84/294 |
| 3,435,721 | A | * | 4/1969 | Dopera | 84/296 |
| 3,871,263 | A | * | 3/1975 | Telesco | 84/271 |
| 3,931,753 | A | * | 1/1976 | Dopera | 84/296 |
| 4,026,181 | A | * | 5/1977 | Barcus et al. | 84/291 |
| 4,068,553 | A | * | 1/1978 | Dopyera | 84/296 |
| 4,104,945 | A | * | 8/1978 | Bolin | 84/725 |
| 4,172,404 | A | * | 10/1979 | Dopyera | 84/291 |
| 4,823,668 | A | * | 4/1989 | Marrs | 84/296 |
| 4,903,567 | A | * | 2/1990 | Justus | 84/294 |
| 5,355,756 | A | * | 10/1994 | Geiger | 84/270 |
| 5,410,936 | A | * | 5/1995 | Ellsworth et al. | 84/298 |
| 5,542,329 | A | * | 8/1996 | Chen | 84/291 |
| 5,780,758 | A | * | 7/1998 | McGill | 84/296 |
| 5,854,435 | A | * | 12/1998 | Kim | 84/291 |
| 7,151,210 | B2 | * | 12/2006 | Janes et al. | 84/291 |
| 2008/0053289 | A1 | * | 3/2008 | Bryan | 84/291 |

* cited by examiner

*Primary Examiner* — David Warren
*Assistant Examiner* — Robert W Horn
(74) *Attorney, Agent, or Firm* — Plager Schack LLP

(57) ABSTRACT

A guitar comprising a sound box that comprises an upper sound board having a sound hole, a lower sound board, a resonator plate comprising a relatively thin sturdy material exhibiting a vibrational springy characteristic, with the resonator plate supporting a bridge, and a resonator conductor positioned between the upper and lower sound boards for transmitting vibrations directly from the resonator plate to the lower sound board and to create additional air vibrations within the sound box.

7 Claims, 6 Drawing Sheets

RESONATING GUITAR WITH RESONATOR CONDUCTOR

BACKGROUND

The guitar has a long rich history, with several types emerging over the milennia. Not withstanding the wide variety of styles, generally there are two main types of guitars—acoustic and electric, with some hybrids commercially available in recent years. Acoustic guitars have hollow bodies and have been in use for over a thousand years. Acoustic guitars are typically strung with nylon or steel strings, which are plucked with the users fingers or strummed with the user's hand. The guitar generally comprises a body and a neck, with a set of strings supported tautly by one end of the neck and the other end (or middle) of the body, typically over a bridge for transferring string vibrations. Guitars vary widely not only to accommodate the various types of sound qualities desired, but also to display aethestic qualities that reflect the user's particular style or personality. With acoustic guitars, the body comprises a hollow sound box, as explained below. Electric guitars usually do not have a hollow sound box, although some do.

Guitars produce sound through amplifying the vibration of the strings as the user strums the strings. Sound is produced when the air surrounding a source of sound is displaced, creating waves. Those waves register in many ways, not the least of which is a user's ear. However, the size of the strings themselves are relatively small, so the amount of air this displaced when a string is stummed is slight. In order to enhance the sound, the strings are supported by a bridge that is connected to a sound board, both of which transmit vibrations from the string to the surrounding area. The much large area of air displacement allows more sound to eminate from the guitar. Further enhancement is provided in one of at least two ways: with resonating guitars, for example common acoustic guitars, enhancement of sound occurs by providing a volume of air housed within the hollow body of the guitar, or the sound box, so that vibrations of the air within the sound box vibrate against both the upper sound board and the lower sound board, although the lower sound board does not have as much resonating effect as the upper sound board because it is usually held against the user.

The air in the cavity defined by the body—sound box—resonates with the vibrational modes of the string. The volume of sound may be increased or decreased depending upon whether the vibrations of the air within the sound box is in phase or out of phase with the vibration of the strings. Importantly, the air in the sound box is coupled to the resonance of the top plate. The sound made by a guitar is a complex mixture of harmonics that gives the guitar its distinctive sound. By using a large surface area to displace a larger volume of air, the guitar takes fairly slight string sounds and produces rich and deep sounds.

One type of acoustic guitar is known as the Dobro® style guitar. According to an on-line site, the name Dobro apparently originated in the late 1920's when the Dopyera brothers formed a company called Dobro, which was both a contraction of "Dopyera brothers" and a Slovak word meaning "goodness." The Dobro® guitar was a resonator guitar created by one of the Dopyera brothers with a single resonator plate having a shallow conical shape pointing outwardly (away from the sound box) and supported by the upper sound board of a sound box. Earlier resonator guitar designs included a single conical resonator plate facing inwardly (toward the interior of the sound box), and a tricone design with three concave resonator plates supported by the upper sound board.

With electric guitars, enhancement of the string sound occurs synthetically through the use of electronic pickup and amplification. It should be noted that there are some electric guitars that include a sound box in a hybrid fashion, enhancing the sound with the resonant configuration of a sound box coupled with electric pickup and amplification. One hybrid model borrow from the Dobro® style guitar in which a conical resonator plate is supported by an upper sound board that also supports an electronic pick up and electronic amplification controls.

As a person of ordinary skill in the art may appreciate, depending upon the configuration of the guitar body, the materials used, and adjunct components added, the quality and appeal of the sound generated may vary widely. Each may provide a range of sound suitable for the style of music desired, and of course may depend upon the personality of the listener. However, there remains a dedicated effort in the industry to generate more robust and valuable sounds from acoustic, electric and hybrid guitars. Many existing guitars provide excellent sound, but others could be improved. One area ripe for improvement is the resonator guitar, which the present invention address, as described and claimed below.

SUMMARY

In embodiments of the present invention, a resonator guitar is provided comprising a sound box configured to partially enclose a volume of air sufficient to increase the resonation generated by the movement of strings on the guitar. The sound box comprises an upper sound board having a generally flat configuration and positioned proximal a set of strings supported on the guitar, with the upper sound plate having an opening therein defined by a rim. In one embodiment, the rim may comprises a shoulder disposed within the opening. The sound box also comprises a lower sound board having a generally flat configuration and positioned generally parallel with the upper sound board to define a space between the upper and lower sound boards along with a side board connecting the upper and lower sound boards in a manner so as to enclose a volume of air. The sound box may be made of metal or wood, or candidly any other material that permits sturdy but vibration-transmitting capability.

In embodiments of the present invention, the upper sound board supports a resonating plate comprising a relatively thin sturdy material exhibiting a vibrational springy characteristic, with the resonating plate supporting a bridge that is itself configured to support a set of guitar strings in a taut manner, where the bridge and plate collectively serve to transmit the resonating vibrations of the strings when strummed (or picked) into the interior of the sound box. In one embodiment, the resonating plate has a fairly shallow truncated conical configuration, with a flat surface at the apex of the truncated cone. In some configurations, the truncated conical resonating plate may be positioned with its apex pointing outwardly away from the interior of the sound box. In other configurations, the apex may be pointing inwardly. Alternatively, the resonating plate may have a geometrically flat configuration, or may have a slight (or pronounced) spherical arcuate shape. Like the sound box, the resonating plate may be made of metal or wood, or any other material that permits sturdy but vibration-transmitting capability, and may be provided with aesthetic, decorative or informative indicia or designs. In one embodiment, the resonating plate comprises an aluminum material.

In any of the above cases, the resonating plate is supported by the upper sound board in one of several possible ways. In some embodiments, the resonating plate is larger than the opening in the sound board so that the resonating plate, when secured to the upper sound board, covers the opening, but still translates vibrations generated by the strings into the interior of the sound box. In others, the resonating plate is sized to fit within the rim of the opening, resting securely on, for example, a shoulder within the rim.

Importantly, the sound box further comprises a resonating conductor positioned between the resonating plate and the lower sound board, with the resonating conductor comprising, in one example, a stiff and sturdy material for transmitting vibrations directly from the resonating plate to the lower sound board and to create additional air vibrations within the sound box. In some embodiments, the resonating conductor is a resonating cylinder comprising a closed end and an open end, with the resonating cylinder preferably positioned with its open end against an interior face of the bottom sound board and secured thereto. In other embodiments, the resonating conductor is a generally U-shaped channel that permits secure engagement of the conductor between the resonating plate and the lower sound board.

In this arrangement, the resonating plate may be secured to the closed end of the resonating cylinder in a manner that secures the resonating plate within the rim of the upper sound board. Preferably a bridge is secured to the exterior of the resonating plate to support the strings. This arrangement permits direct vibrational communication between the strings and the bottom sound board through the bridge, resonating plate and resonating cylinder. In some embodiments, the resonating cylinder may comprise apertures within the sidewall of the cylinder to permit some fluid communication of air between the interior of the cylinder and the rest of the interior of the sound box. Other configurations are contemplated for the resonating conductor as well.

BRIEF DESCRIPTION OF THE FIGURES

The detailed description of some embodiments of the invention will be is made below with reference to the accompanying figures, wherein like numerals represent corresponding parts of the figures.

DETAILED DESCRIPTION OF CERTAIN EMBODIMENTS

Figure 1:
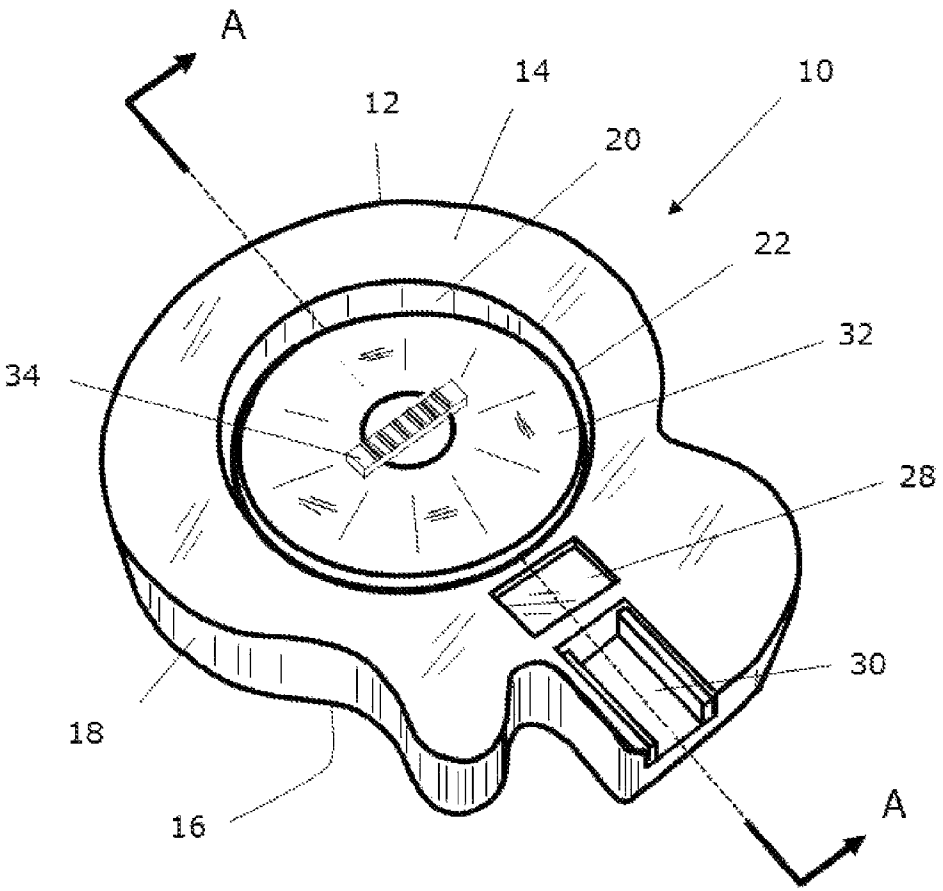
FIG. 1 shows a schematic perspective view of one embodiment of a resonator guitar.
Figure 2:
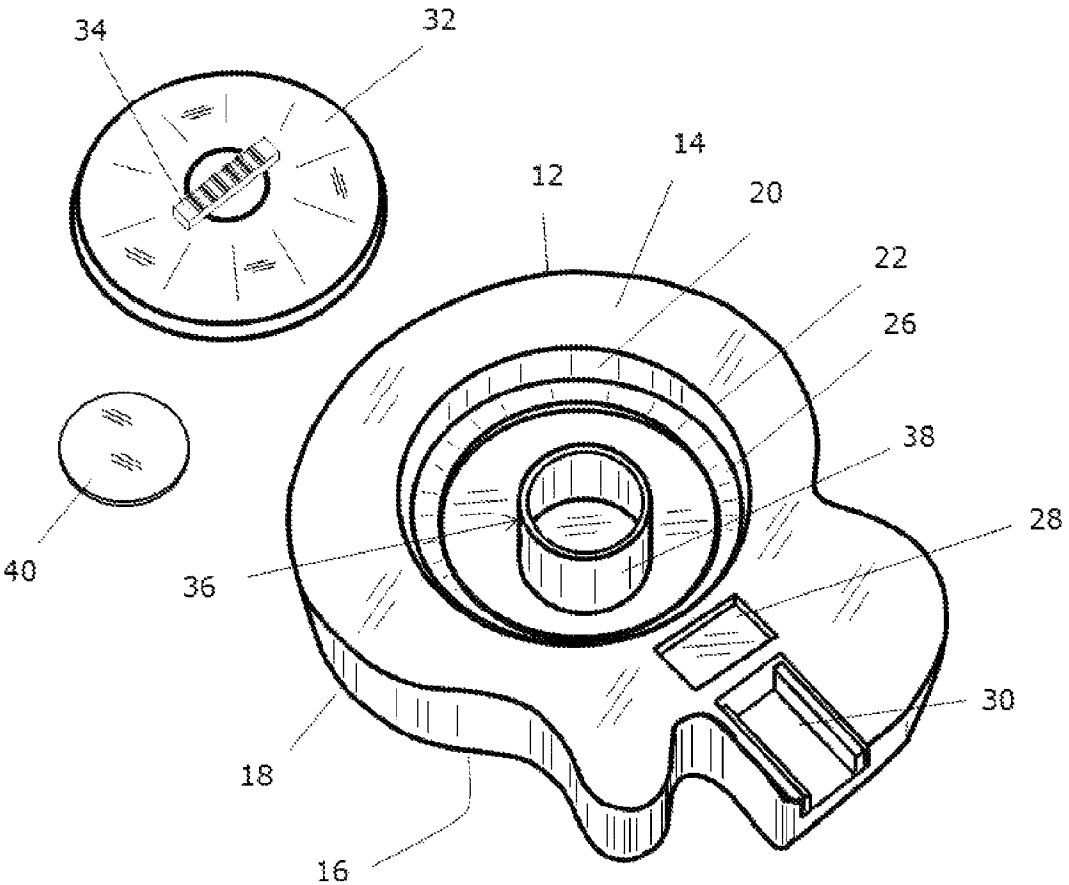
FIG. 2 shows a schematic perspective view of the embodiment of FIG. 1 with some of the components removed to expose the interior, including a resonator conductor having the configuration of a cylinder.

By way of example, and referring to FIGS. 1 and 2, one guitar embodiment 10 comprising a resonating conductor may be described. Guitar 10 comprises a sound box 12 that itself comprises an upper sound board 14, a lower sound board 16 and a side sound board 18. As can be appreciated, the shape and size of the guitar sound box 12 may vary depending upon the style and sound desired by the user and/or manufacturer. In this exemplary embodiment, the sound box 12 of guitar 10 comprises a curvilinear configuration defining a somewhat classic style of guitar sound box. However, other curvilinear configurations are contemplated, including some sound boxes with only straight and/or angled sides, i.e., with a plurality of side board facets, or those with an entirely arcuate arrangement of convex and concave portions. Each variation brings a slightly nuanced difference in sound generated, but more often than not presents an aesthetic that reflects the personality of the guitar player.

The upper and lower sound boards comprise a generally flat configuration and are preferably made of material that exhibits a sufficient resilience or springiness to vibrate in response to the strumming or plucking of strings. Traditional sound boards have been made of wood, but some are made of metal or laminates. One preferable material is aluminum, which exhibits a light weight, sturdy by sufficient resilient and springy quality to generate high quality sound. The generally flat upper and lower sound boards may be entirely geometrically flat or may comprise a cambered profile, or a combination of both; i.e., with some portions geometrically flat and some portions cambered, but each generally flat. The upper and lower boards of a single sound box need not have the same profile, so for example an upper sound board may be generally flat with only a nuanced camber and the lower sound board may have a more pronounced camber presenting a fairly convex profile.

Unlike conventional electric guitars, the present inventive embodiments of guitars comprise a sound box, so the upper sound board 14 comprises at least a single resonator opening 20 having a peripheral rim 22. In some embodiments, the opening 20 is generally circular, meaning it could be geometrically circular, or it could be slightly ovate. In other embodiments, the opening may comprise a different geometry. In the exemplary embodiment of FIGS. 1 and 2, the opening 20 is generally circular and further comprises a shoulder 26 set into the sound box 12 to present a surface upon which other components may reside. Where it is desired to electronically amplify the sound generated by the inventive guitars described herein, an optional pickup, or pickups, may be employed. In that regard, the upper sound board 14 may further comprise a pick up opening 28 having any configuration necessary to accommodate the desired style or brand of pickup available. Of course, the sound box 12 may further comprise a neck connection 30, which can be one of any configurations suitable for joining detachable or permanently a guitar neck. The particulars of the neck are not important to understanding the invention presented herein, so very little of this description is dedicated to the neck itself. The particular exemplary embodiments of FIGS. 1 and 2 comprise a neck connection 30 configured to permit the neck to slidably engage the sound box 12 along a plurality of corresponding channels.

The sound box 12 further comprises a resonator plate 32 supporting a bridge 34 thereon. In this exemplary embodiment, the resonator plate 32 comprises a circular plate having a slightly tapered profile, but other configurations are contemplated. As with the sound boards themselves, the resonator plate 32 should preferably be made of a resilient springy material that exhibits vibrational characteristics suitable to the desired sound to be generated. Although not always desired from a commercial standpoint, the resonator plate may be secured to the upper sound board in a manner that permits interchangeability with other resonator plates having slightly different vibrational characteristics for varying the sound generated by the guitar. In the exemplary embodiment of FIGS. 1 and 2, the resonator plate 32 rests within the rim 22 of opening 20 of the upper sound board 14, and preferably directly on the shoulder 26.

Figure 5:
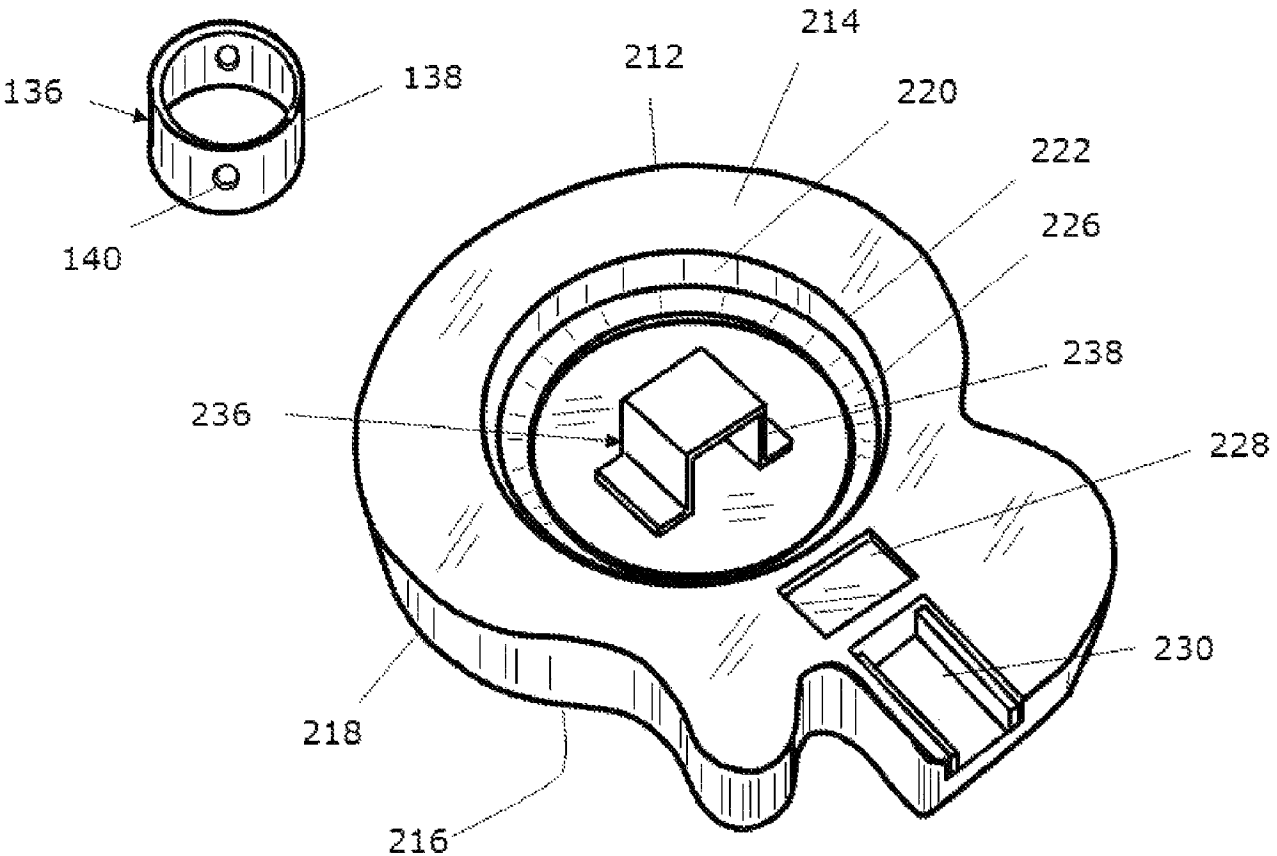
FIG. 5 shows a schematic view of two alternative embodiments of resonating conductors.

In FIG. 2, the resonator plate 32 (with bridge 34 secured thereon) has been removed to expose the interior of the sound box 12. There, it can be seen that the inventive sound box 12 further comprises a resonator conductor 32 that enhances the sound quality otherwise generated by a guitar with no resonator conductor. With this particular embodiment 10, the resonator conductor 36 comprises a wall 38 having a generally cylindrical shape. The resonator conductor 36 is preferably secured to the lower sound board 16, and further comprises a resonator conductor cap 40 (shown detached) that is secured to the top of the resonator conductor 36. The resonator conductor 36 and the resonator plate 32 are configured such that when the plate 32 is placed on top of the resonator conductor 36 and secured thereto, the rim of the resonator plate 32 rests cleanly on the shoulder 26 of the upper board opening 20. The resonator cap 40 is preferably secured to the resonator conductor 36, and the resonator plate 32 is secured to the resonator conductor 36, in such a way as to conduct vibrational energy directly from the bridge to the resonator plate 32 to the resonator conductor 36 to the lower sound board 16. Of course the vibration of the strings would translate indirectly to the lower sound board through the interior of the sound box 12 by the impact of the vibration of the upper sound board 14 on the air within the sound box 12. But the employment of the resonator conductor 36 also adds directly vibrational translation that enhances the sound generated and creates a robust and desirable sound quality from the guitar. The resonator conductor 36 is preferably made of material that itself has the ability to vibrate the air surrounding the resonator conductor 36 within the sound box 12 and supplement the harmonic output. In one embodiment, it is made of metal, and preferably aluminum, but numerous other materials are contemplated as well. In an alternative configuration, the resonator conductor 36 may have one or more holes in the wall 38, as shown in FIG. 5.

Figure 3:
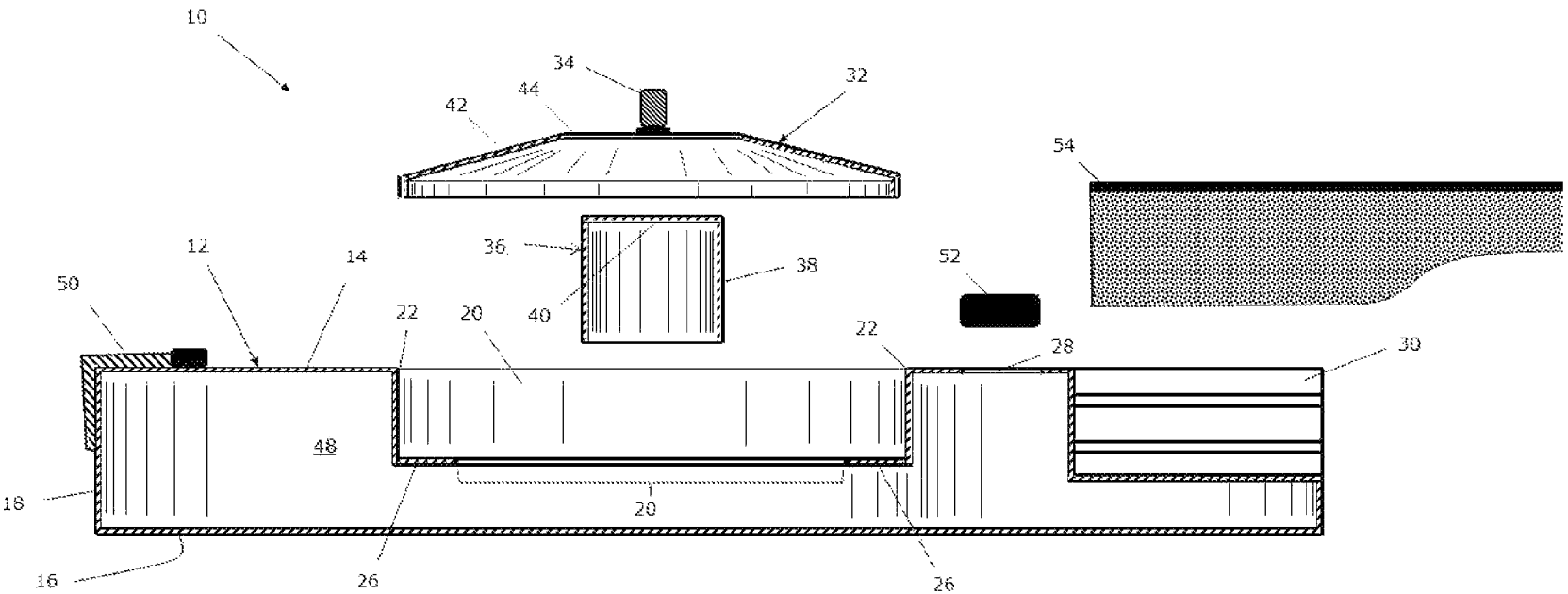
FIG. 3 shows a schematic partially exploded elevational view of the guitar of FIG. 1 in cross-section along line A-A.
Figure 4:
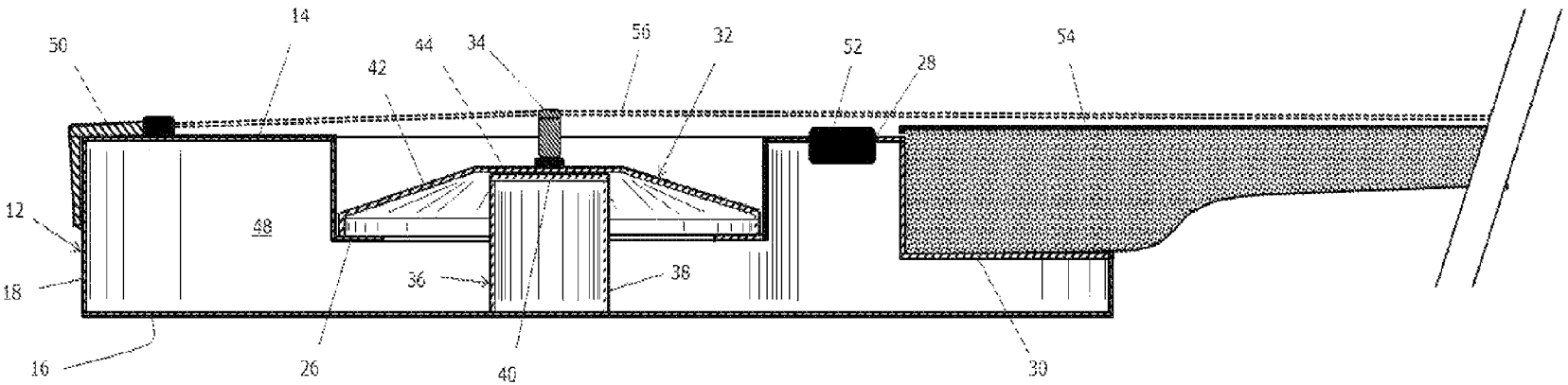
FIG. 4 shows a schematic elevational view of the guitar of FIG. 3, with all components shown in place as used.

Referring now to FIGS. 3 and 4, the same exemplary guitar 10 may be appreciated from a different orientation. In that regard, the guitar 10 comprises a frustoconically-shaped resonator plate 32 comprising a resonator plate wall 38, with at least of a portion thereof forming a top wall 44 having a generally flat surface corresponding to the resonator conductor cap 40, and configured to engage the cap 40 in one of a number of possible mechanical fashions, including bolts (not shown). The periphery of the resonator plate 32 rests upon the shoulder 26 within the rim 22 of the upper sound board 14. As explained above, the resonator conductor 36 may be secured to the lower sound board 16 via welding or other means. When there are no strings in place blocking the resonator plate 32 and opening 20 of the upper sound board 20, it is possible to remove the resonator plate 32 and replace it with another of the same or similar style or material. It is preferable that whatever resonating plate style or material is used, at least in the embodiment illustrated in FIG. 4, the lower rim of the resonator plate 32 engage the shoulder of the upper sound board 14 when the resonator conductor top wall 44 is resting securably on top of the resonator conductor cap 40. Such an arrangement is not critical, but is helpful to minimize the amount of fluid communication of air between the interior 48 of the sound box 12 and the ambient.

It should be noted that the depth of the shoulder 26 within the interior of the sound box, or whether there is a shoulder at all, depends upon the desires of the user and/or manufacturer. In an alternative embodiment, the size of the resonating plate is such that it is larger than opening 20 in the upper sound board 14 so that the resonator plate rests tightly again the upper sound board directly, rather than a shoulder. With that arrangement, it would be preferable that the resonator plate be shallower so that the bridge does not force the strings supported thereon too far outwardly from the sound box. Also with such an arrangement, the height of the resonator conductor may need to be larger than is shown schematically in FIG. 4 so that the resonator plate rests securely on the resonator conductor.

The upper and lower sounds boards, coupled with the side board 18, define an interior 48 of the sound box 12. As illustrated, it is intended that at least a part of the resonator conductor 36 be positioned within the interior 48 of the sound box 12.

A shown in FIG. 4, the guitar 10 further comprises a string retainer 50, an electronic pick up 52 (black boxed in this illustration), a neck 54 supported within the next connector 30 of the sound box 12, and a set of strings 56, supported on the bridge 34 secured to the resonator conductor top wall 44 of the resonating plate 32.

As alluded to above, alternative embodiments are contemplated for the inventive instrument described herein. Referring to FIG. 5, another example of a resonator conductor 136 comprises a generally cylindrical tube 138 having one or more holes 140 therein. An entirely different style of resonator conductor 236 is shown in FIG. 5 as well, positioned within a guitar sound box 212. In that regard, resonator conductor 236 comprises a generally U-shaped channel 238 that is configured to be securable within the rim 222 of opening 220 of upper sound board 214, and secured to the lower sound board 216. The resonator conductor may comprise other configurations of channel or material that may present an enclosed member of a semi-closed member; i.e., with holes therein or open sides, etc.

A shoulder 226, similar to the shoulder 26 of embodiment 10 shown in FIGS. 1 through 4 is also provided, but again is not critical, and indeed may be eliminated altogether. Any one of a number of possible resonator conductor configurations is contemplated, including examples 36, 136 and 236, with each being generally substitutable with each other within the same guitar, if so desired. Again it is preferable that the resonator conductor be secured to the bottom sound board in a permanent fashion, such as through welding (if the resonator conductor and the lower sound board is made of metal), but it is not critical. The means in which the resonator conductor is secured may impact the harmonics, which implicates the sound generated. It may be that a more pleasing sound is generated by welding, and in other cases in may be that a more pleasing sound is generated by bolting, or with threaded screws or a strong adhesive where both components are made of wood.

It is important to note that while it is preferable that the resonator conductor and resonator plate be configured so as to permit meaningful engagement of one to the other to enhance vibrational translation, there is no set requirement that one style resonator conductor must be used with a certain style resonator plate. Indeed, the alternative resonator conductor 236 may functional well with the resonator plate 32 shown in FIGS. 1 through 4, or it may work well with an alternative resonator plate show in FIG. 6.

Figure 6:
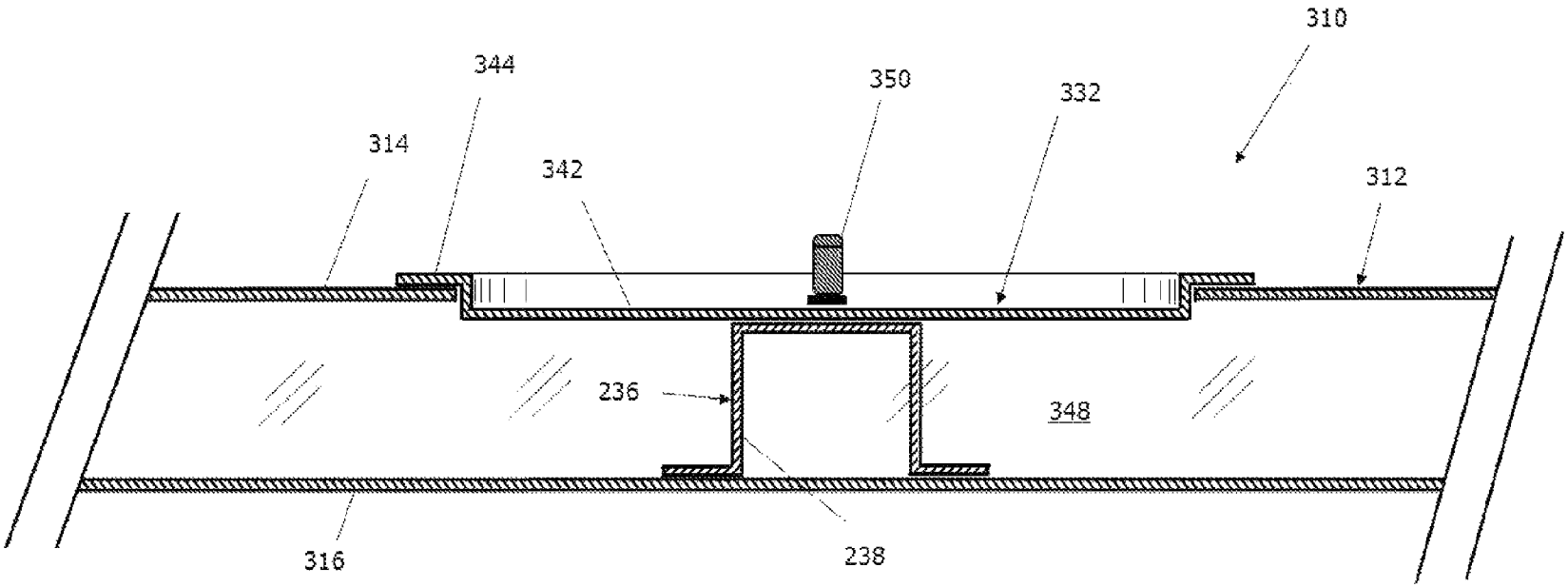
FIG. 6 shows a schematic view of an alternative embodiment employing a resonating conductor having a non-cylindrical configuration and a generally flat resonating plate.

Referring to FIG. 6, an alternative embodiment guitar 310 comprises a sound box 312 comprising an upper sound board 314 and a lower sound board 316 defining an interior 348 therewithin. The sound box 312 further comprises the resonator conductor 236 comprising the U-shaped channel 238, similar to that shown in FIG. 5. But in the embodiment 310 of FIG. 6, an alternative resonating plate 332 is provided comprising a generally flat plate 342 having a generally circular periphery and a raised shoulder 344 for resting on the upper sound board 314. Like the resonating plate 32 of the embodiment of FIGS. 1 through 4, this resonating plate 332 rests within an opening in the upper sound board. However, as explained above, the resonating plate 332 need not be configured to rest within the rim of the opening, but may be sized so that it rests on top of the upper sound board. In either case, the size of the resonating conductor 236 should be such that the resonating plate 332 and the resonating conductor 236 can engage to permit vibrational translation. They need not touch if other means of conducting vibrations are placed in between. It is contemplated even that a space be placed between the resonating plate 332 and the resonating conductor 236 to create a relatively thin volume of air to translate vibrational energy between the components. As with other embodiments, the resonating plate 332 is configured to carry a bridge 350 thereon to support the strings and to translate vibrational energy from the strings (not shown) to the resonating plate 332 to the resonating conductor 236 to the lower sound board 316.

With the embodiment illustrated in FIG. 6, a preferable material for the resonating plate 332 is wood. However, other materials are contemplated as well, including metal. If so desired, the resonating plate may carry one or more designs visible to the guitar user, which may serve as an emblem or other indicia of the user's personality and tastes.

Still other embodiments of sound box components are contemplated by the present invention, too numerous to mention all practically. However, a person of ordinary skill in the art should appreciate that at least one inventive value of the embodiments described herein is to enhance the quality of sound generated by a resonating guitar by providing a means for transferring vibrational energy from the strings to the bottom (back) of the sound box directly and indirectly. The scope of the invention, therefore, should be measured by the scope of the claims presented below, rather than by the exemplary embodiments described herein.

What is claimed is:

1. A resonating guitar comprising a sound box configured to increase the resonation generated by the vibration of strings when placed on the guitar, the sound box comprising:

an upper sound board having a generally flat configuration and positioned proximal a set of strings supported on the guitar, the upper sound plate having an opening therein defined by a rim;

a lower sound board having a generally flat configuration and positioned generally parallel with the upper sound board to define a space between the upper and lower sound boards;

a side board connecting the upper and lower sound boards in a manner so as to enclose a volume of air; the side board comprising at least one curvilinear panel;

a resonator plate comprising a relatively sturdy material exhibiting a vibrational springy characteristic; the resonator plate supporting a bridge that is itself configured to support a set of guitar strings in a taut manner when positioned thereon, the bridge and resonator plate collectively configured to transmit the resonating vibrations of strings when strummed into the interior of the sound box, said resonator plate configured to rest on a shoulder within the rim of said opening of said upper sound board; and a resonator conductor positioned between the resonator plate and the lower sound board, the resonator conductor comprising a generally sturdy material for transmitting vibrations directly from the resonator plate to the lower sound board and to create additional air vibrations within the sound box.

2. The guitar of claim 1, wherein the resonator plate has a truncated conical configuration.

3. The guitar of claim 1, wherein the resonator conductor comprises a resonator cylinder comprising a closed end and an open end, the resonator cylinder positioned with its open end secured against an interior face of the bottom sound board.

4. The guitar of claim 3, wherein the resonator plate is attached to the closed end of the resonator cylinder.

5. The guitar of claim 2, wherein the truncated conical resonator plate is positioned with the apex of the plate pointing away from the interior of the sound box.

6. The guitar of claim 1, wherein the resonator plate comprises wood.

7. The guitar of claim 1, wherein the resonator conductor comprises a generally U-shaped channel.

* * * * *